US009190716B2

(12) United States Patent
Robson et al.

(10) Patent No.: US 9,190,716 B2
(45) Date of Patent: Nov. 17, 2015

(54) REFLECTOR

(75) Inventors: David Robson, Appleby-in-Westmorland (GB); Simon John Stirland, Hitchin (GB)

(73) Assignee: ASTRIUM LIMITED, Hertfordshire (GB)

( * ) Notice: Subject to any disclaimer, the term of this patent is extended or adjusted under 35 U.S.C. 154(b) by 530 days.

(21) Appl. No.: 12/707,224

(22) Filed: Feb. 17, 2010

(65) Prior Publication Data

US 2010/0295753 A1 Nov. 25, 2010

Related U.S. Application Data

(63) Continuation-in-part of application No. 12/247,424, filed on Oct. 8, 2008, now abandoned.

(30) Foreign Application Priority Data

Sep. 5, 2008 (EP) ..... 08163748

(51) Int. Cl.

| | |
|---|---|
| ***H01Q 15/14*** | (2006.01) |
| ***H01Q 1/28*** | (2006.01) |
| ***H01Q 15/16*** | (2006.01) |
| ***H01Q 19/10*** | (2006.01) |

(52) U.S. Cl.

CPC ..... *H01Q 1/288* (2013.01); *H01Q 15/148* (2013.01); *H01Q 15/16* (2013.01); *H01Q 19/10* (2013.01)

(58) Field of Classification Search

USPC ..... 343/772, 839, 840, 914, 912

See application file for complete search history.

(56) References Cited

U.S. PATENT DOCUMENTS

| | | | | |
|---|---|---|---|---|
| 4,631,547 | A * | 12/1986 | Jacavanco | 343/840 |
| 4,644,359 | A | 2/1987 | Katagi | |
| 5,796,370 | A * | 8/1998 | Courtonne et al. | 343/781 R |
| 5,797,082 | A * | 8/1998 | Lusignan | 725/70 |
| 5,913,151 | A | 6/1999 | Lusignan | |
| 6,489,929 | B1 | 12/2002 | Duchesne et al. | |

(Continued)

FOREIGN PATENT DOCUMENTS

| | | | |
|---|---|---|---|
| DE | 2416541 | A1 | 10/1975 |
| DE | 3728976 | A1 | 3/1989 |

(Continued)

OTHER PUBLICATIONS

English Translation of the Office Action issued in Japanese Patent Application No. 2011-525567, dated Feb. 19, 2013, 3 pages.

(Continued)

*Primary Examiner* — Tan Ho

(74) *Attorney, Agent, or Firm* — Lando & Anastasi, LLP

(57) ABSTRACT

A satellite antenna arrangement for a satellite communication system comprising: a reflector for producing a far field pattern with near-zero field strength at a predetermined location to reject unwanted signals from said predetermined location or minimize signal power transmitted to said predetermined location, the reflector having a surface comprising a stepped profile arranged to generate the near-zero field strength in the predetermined location. The stepped profile may comprise a radial step. The location of the near-zero field strength can be steered by moving the reflector or by adjusting the amplitude and phase of an additional beam that covers substantially the same region as the main beam reflected by the reflector.

18 Claims, 16 Drawing Sheets

(56) References Cited

U.S. PATENT DOCUMENTS

| | | | | |
|---|---|---|---|---|
| 7,737,903 | B1 * | 6/2010 | Rao et al. | 343/786 |
| 2006/0012538 | A1 | 1/2006 | Waltman | |

FOREIGN PATENT DOCUMENTS

| | | | |
|---|---|---|---|
| JP | S50-015341 | | 6/1975 |
| JP | S57-097705 | | 6/1982 |
| JP | 58103205 | A | 6/1983 |
| JP | S58-177006 | | 10/1983 |
| JP | 11298237 | A | 10/1999 |
| JP | 2002-512462 | A | 4/2002 |
| WO | 2004004070 | A1 | 6/2003 |
| WO | 2005069443 | A1 | 7/2005 |
| WO | WO 2005069443 | A1 * | 7/2005 |
| WO | 2007002235 | A2 | 1/2007 |

OTHER PUBLICATIONS

EPO Communication for European Patent Application No. 09782644.0, mailed Apr. 3, 2013, 5 pages.

* cited by examiner

REFLECTOR

RELATED APPLICATIONS

This application is a continuation-in-part application of U.S. application Ser. No. 12/247,424, entitled "A REFLECTOR," filed on Oct. 8, 2008 which is incorporated by reference in its entirety herein.

FIELD OF THE INVENTION

The invention relates to a reflector for a reflector antenna for producing a far field radiation pattern having near-zero field strength in a predetermined region.

BACKGROUND OF THE INVENTION

Satellite communication has become an important part of our overall global telecommunication infrastructure. Satellites are being used for business, entertainment, education, navigation, imaging and weather forecasting. As we rely more and more on satellite communication, it has also become more important to protect satellite communication from interference and piracy. There is now a demand from commercial satellite operators for satellite antennas that provide rejection of unwanted signals or minimise signal power to unwanted receivers.

Especially, satellite communication can be degraded or interrupted by interfering signals. Some interference is accidental and due to faulty ground equipment. Other interference is intentional and malicious. By directing a powerful signal at a satellite, the satellite can be jammed and prevented from receiving and retransmitting signals it was intended to receive and retransmit.

The above mentioned problems can be solved by creating a receive or transmit radiation pattern with zero or near-zero field strength, also known as a null, in the direction of the interfering signal or the unwanted receiver. Conventionally, a region of zero directivity or a null in a radiation pattern is produced by the summation of a main pattern having a wide flat gain distribution and a cancellation beam which is of the same amplitude but in antiphase with the main beam at the required location of zero field strength. It is known to use multiple feed elements carefully combined with the correct relative amplitude and phase to produce such cancellation.

Most commercial satellites these days use reflector antennas shaped to provide the desired regional coverage. The surface of the reflector in the reflector antenna can be modified during the design process using reflector profile synthesis software to produce the required beam pattern. An example of suitable reflector profile synthesis software is POS from Ticra. Reflector profile synthesis software of the type used in synthesising shaped reflectors for contoured beams can also be used to generate a pattern with low field strength in a predetermined direction. The reflector profile synthesis software numerically analyses the desired far field to suggest a surface profile of the reflector in order to create the desired beam. An example of a surface profile of a conventional reflector for producing a pattern with low field strength in a predetermined position is shown in FIG. 1. An example of a far field radiation pattern generated by a conventional reflector for producing a pattern with low field strength in a predetermined position is shown in FIG. 2. The min/max algorithms employed by conventional synthesis software to produce the appropriate surface profile rely on making smooth, differentiable changes to the surface and the resulting field, close to the zero, exhibits the typical quadratic behaviour of a cancellation beam approach. A problem with this approach is that quadratic cancellation patterns are sensitive to random surface errors of the reflector and to errors in the feed pattern as shown in FIGS. 8*b* and 9*b*.

The invention aims to improve on the prior art.

SUMMARY OF THE INVENTION

According to the invention, there is provided a satellite antenna arrangement for a satellite communication system comprising: a reflector for producing a far field pattern with near-zero field strength at a predetermined location to reject unwanted signals from said predetermined location or minimise signal power transmitted to said predetermined location, the reflector having a surface comprising a stepped profile arranged to generate the near-zero field strength in the predetermined location.

The reflector may be shaped to produce a contoured beam. The location of near-zero field strength may be located adjacent the contoured beam. The location of near-zero field strength may be located off centre with respect to the contoured beam. The location of the near-zero field strength may also be within the contoured beam.

The reflector may have a parabolic shape and produce a spot beam.

The stepped profile may comprise a radial step. A radial step means a step with a step edge in the radial direction. The stepped profile may also comprise a spiral step. The stepped profile may also be a smoothed stepped profile providing an adequate approximation to the ideal, discontinuous step. The stepped profile may define a phase singularity in the aperture field pattern of the antenna.

The phase of said far field pattern in the vicinity of the position of the near-zero field strength may progressively increase through 360° with angular progression through 360° around the position and the amplitude of said far field pattern in the vicinity of the position may vary substantially linearly about said position of near-zero field strength.

The satellite antenna arrangement may further comprise a feed for receiving radiation from said reflector or transmitting radiation towards said reflector.

The invention consequently provides a reflector antenna suitable for rejecting unwanted signals or minimising signal power to unwanted receivers. The stepped profile produces a sharp, deep region of near-zero field strength which is robust in the presence of reflector surface or feed pattern errors. The location of the near-zero field strength can subsequently be steered. The satellite antenna arrangement may comprise a positioning mechanism for steering the reflector to reposition the location of the near-zero directivity. Alternatively, or additionally, the satellite antenna arrangement may comprise a radiator for generating the radiation pattern for repositioning the location of near-zero directivity. The feed for receiving radiation from said reflector or transmitting radiation towards the reflector may comprise a first feed and said radiator may comprise a second feed positioned to point directly towards the far field and configured to produce a beam that covers substantially the same region as a beam reflected by the reflector, the second feed being controllable to adjust the amplitude and phase of the beam of the second feed for repositioning the location of near-zero field strength. The beam of the second feed may be a low resolution beam.

According to the invention, there is also provided a satellite payload incorporating the satellite antenna arrangement. The payload may further comprise other communications apparatus such as further antennas, receivers and high power amplifiers.

According to the invention, there is also provided a reflector for a reflector antenna shaped to produce a contoured beam and comprising a stepped profile to generate a region of near-zero field strength in the far-field of the antenna, the stepped profile being arranged to generate the region of near-zero field strength off centre or adjacent the contoured beam. The stepped profile may comprise a radial or a spiral step.

Furthermore, according to the invention, there is provided a satellite antenna comprising: a reflector; a first radiator for receiving a beam reflected from the reflector or for generating a beam for reflection by the reflector; and a second radiator to produce a beam that covers substantially the same region as a beam reflected by the reflector, the reflector comprising a stepped profile arranged to generate a region of near-zero field strength in the far-field of the antenna and the second radiator being controllable to adjust the amplitude and phase of the beam of the second radiator for repositioning the location of the near-zero field strength.

BRIEF DESCRIPTION OF THE DRAWINGS

Embodiments of the invention will now be described, by way of example, with reference to FIGS. 3 to 15 of the accompanying drawings, in which.

DETAILED DESCRIPTION

Figure 3:
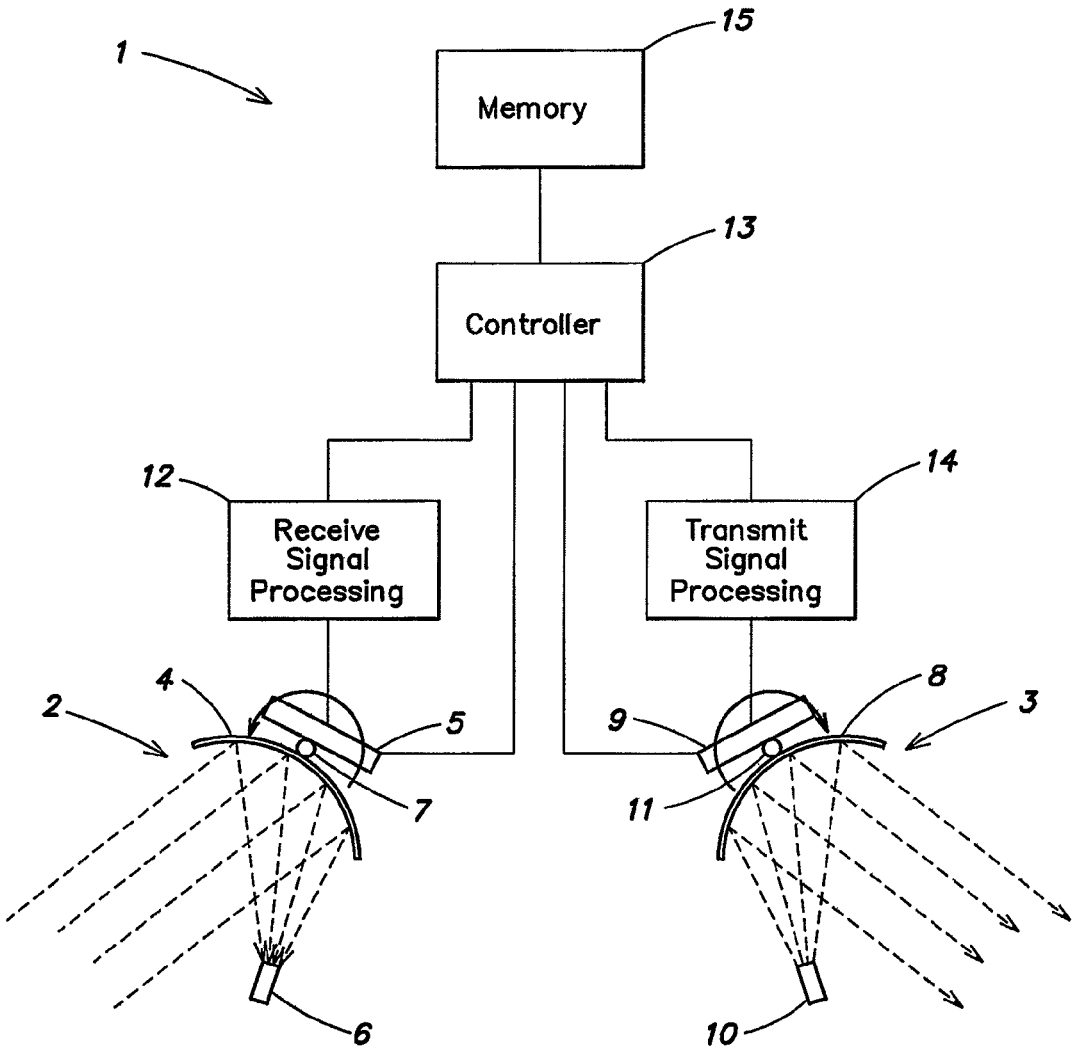
FIG. 3 is a schematic diagram of a communication system.

With respect to FIG. 3, a satellite payload 1 comprises a communication system comprising a receive antenna 2 and a transmit antenna 3. The receive antenna comprises a reflector 4 movably mounted on a frame 5, a feed 6 for receiving the radiation reflected off the reflector 4 and a positioning module 7 for rotating the reflector 4. Similarly, the transmit antenna 3 comprises a reflector 8 rotatable mounted on a frame 9, a feed 10 for generating a beam of electromagnetic radiation for reflection off the reflector 4 and a positioning module 11 for rotating the reflector 4. The satellite payload also comprises a receive signal processing unit 12 for demodulating the received signal, a controller 13 for processing the data and controlling the positioning modules, a transmit signal processing unit 14 for modulating the signal to be transmitted and a memory 15 for storing data and instructions for controlling the reflectors and feeds. Optionally, the controller 13 may be located remotely (e.g. on the ground). The receive and transmit signal processing units 12, 14 comprise suitable amplifiers and filters, as would be understand by the person skilled in the art.

The transmit antenna arrangement 3 will now be described in more detail. It should be understood that many of features of the transmit antenna arrangement also apply to the receive antenna arrangement 2.

When excitation is applied to the feed 10, electromagnetic energy is transmitted therefrom to the reflector 4, causing the reflector to reflect a beam. The reflected energy propagates through a spatial region. The reflector antenna radiation pattern is determined by the radiation pattern of the feed antenna and the shape of the reflector. At great distances, the reflector antenna radiation pattern is approximately the Fourier transform of the aperture plane distribution.

Figure 4:
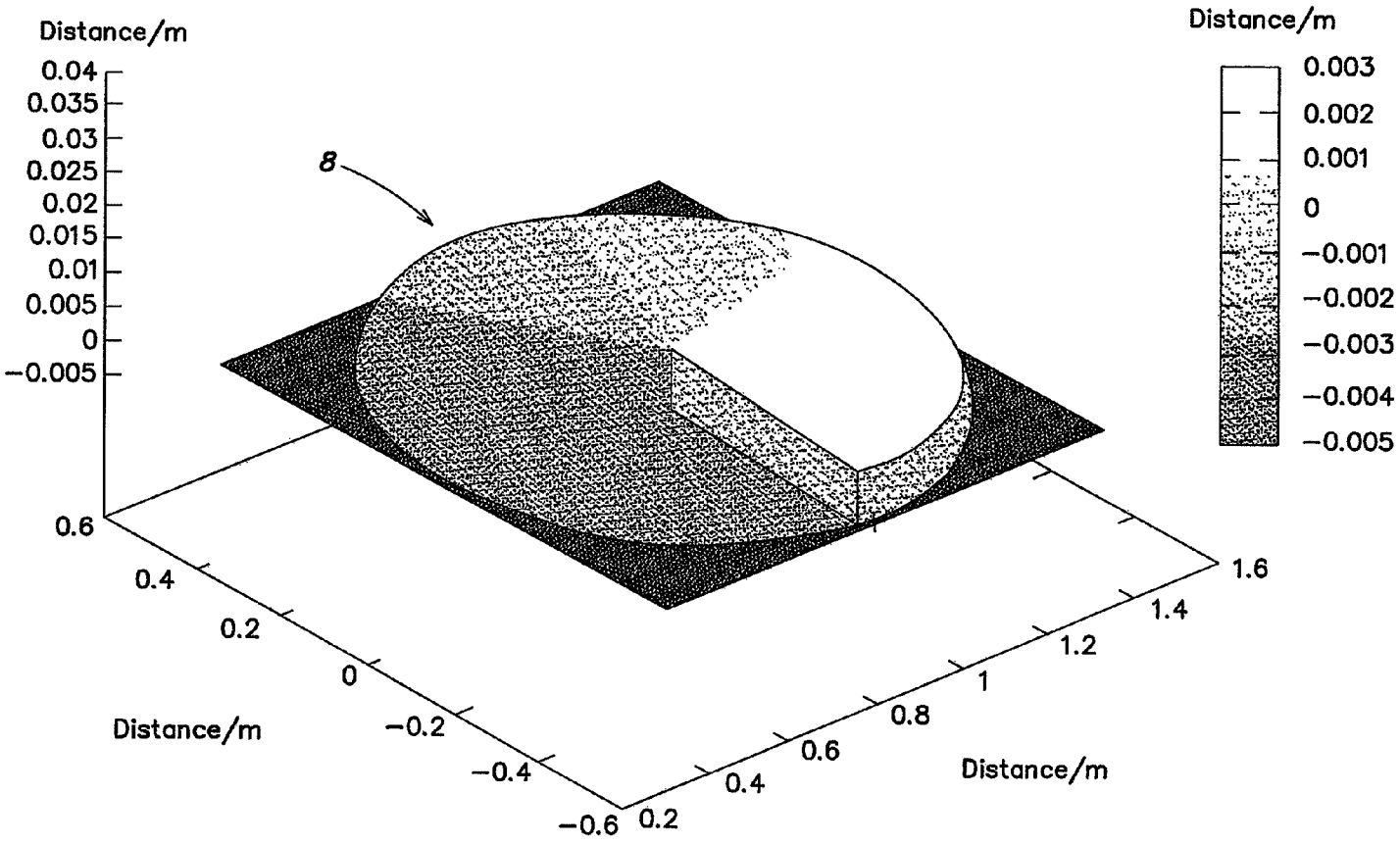
FIG. 4 shows a reflector according to one embodiment of the invention.

The shape of the reflector 4 of FIG. 3 is shown in more detail in FIG. 4. The reflector has a parabolic shape with a radial step for defining a phase singularity in the aperture field pattern of the reflector. Considering an analogy with optics, the reflector may be shaped such that the depth along a locus of all points at a constant distance from the centre of the reflector progressively increases to create a one wavelength variation in optical path length around the antenna aperture. The reflector produces a far field radiation pattern in the form of a spot beam with a near-zero field strength in a predetermined region. The field strength is exactly zero at some point at any single frequency. Over a non-zero solid angle and/or a non-zero bandwidth, the field strength will be only near zero. The reflector displacement is proportional to the imaginary part of the logarithm of the complex amplitude and the radial reflector step is a concrete realisation of a branch cut in the complex plane. A radial step means a step extending in the radial direction. The step may extend from the centre of the reflector to an edge of the reflector.

The feed 10 may be an idealised corrugated horn located at the focal point of the reflector. The feed may transmit a left hand circularly polarised (LHCP) signal which generates a right hand side circularly polarised (RHCP) signal off the reflector 8. The feed typically produces a signal with a frequency of 30 GHz.

The reflector shown in FIG. 4 has a diameter of 1 m, a focal length of 1 m and an offset of 0.5 m. The height of the step is chosen to produce a desired variation in the optical path length in the aperture. The height should be approximately half the wavelength of the radiation. Slightly more than half the wavelength is required because the path length delta is approximately equal to dz(1+cos(theta)), where theta is the total reflection angle and dz is the surface movement parallel to the direction of the reflected ray. The reflector of FIG. 4 would therefore need a height of approximately 6 mm to produce the desired variation in optical path length in the aperture for a signal with a frequency of 30 GHz.

It should be realised by the skilled person that although an embodiment of the invention has been described for a particularly polarised feed for producing a signal with a particular frequency, any suitable polarisation and frequency could be used.

Figure 5:
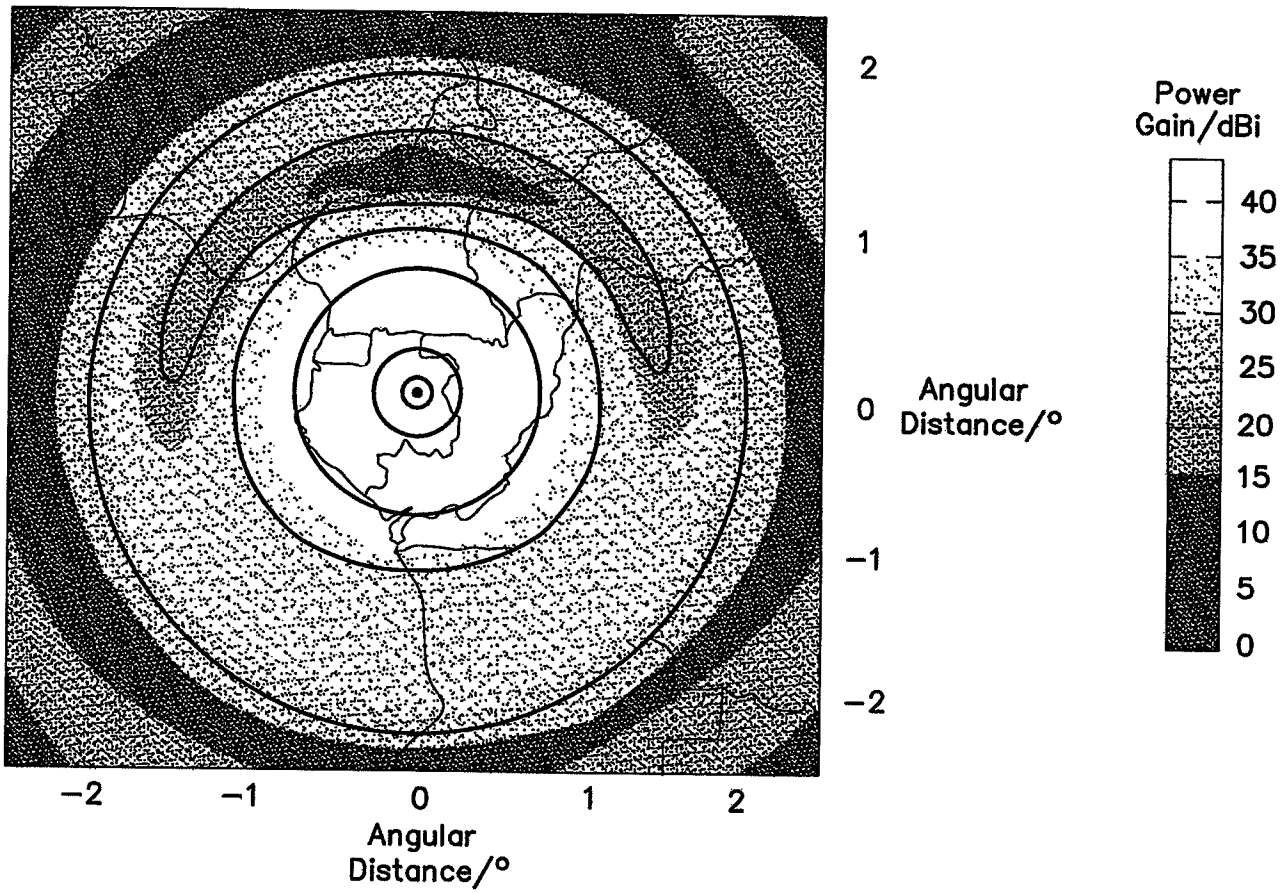
FIG. 5 is a contour diagram of the far field response pattern of the reflector of FIG. 4.
Figure 6:
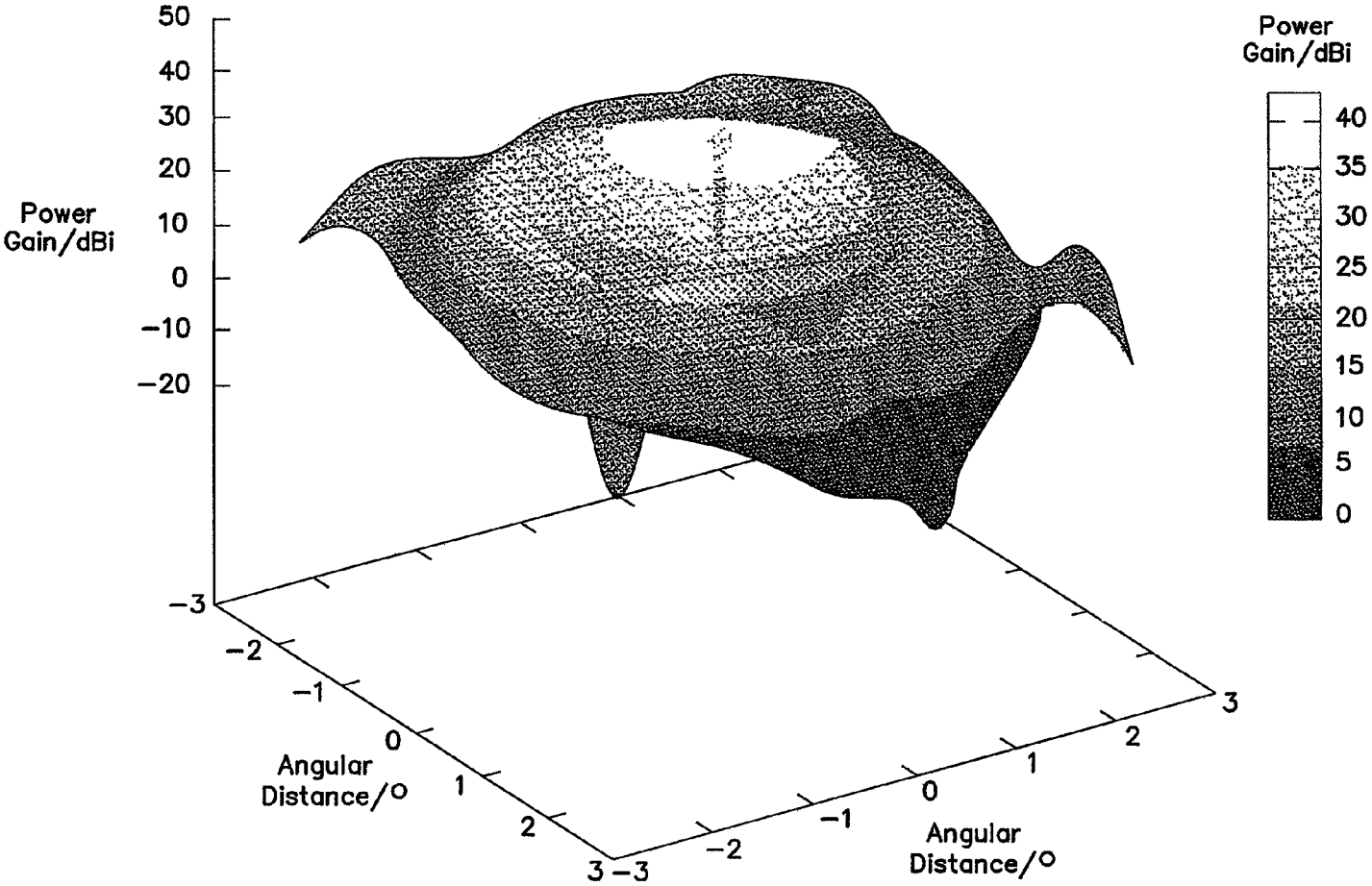
FIG. 6 is a three dimensional illustration of the far field response pattern of the reflector of FIG. 4.

With reference to FIGS. 5 and 6, the far field radiation pattern produced by the reflector has zero amplitude in a predetermined position corresponding to the centre of the spot beam. The amplitude of the far field response pattern in the vicinity of the position varies substantially linearly about said position. The phase of said far field response pattern in the vicinity of said position progressively increases through 360 degrees with angular progression through 360 degrees around the position. In FIG. 5, the contours at 40, 30, 20, 10 and 0 dBi are shown. The maximum amplitude is of the order of 40 dBi.

A receiver located on earth at the position of the near-zero field strength would not be able to pick up a signal from the satellite. Consequently, the near-zero field strength can be used to prevent unwanted receivers from receiving signals from the satellite.

Although the reflector of FIGS. 4, 5 and 6 has been described with respect to a transmit antenna 3, it could also be used in the receive antenna 2 and the receiving pattern of the receive antenna having a reflector as described with respect to FIG. 4 would be identical to the far-field radiation pattern of the transmit antenna, according to the reciprocity theorem.

In a receive antenna, the minimum directivity can be used to avoid a jamming signal. A jamming signal is a high power signal aimed at the satellite antenna to stop the satellite antenna from receiving and processing the signals intended for the antenna. When the location of the source of the jamming signal is determined, the positioning module 7 can be used to adjust the position of the reflector such that the region of near-zero directivity is directed at the source of the jamming signal. That means, of course, that the whole spot beam is displaced. However, without the region of zero directivity, the satellite might not be able to receive any signals at all. As a consequence of the rotation of the reflector 4, the reflector will not be able to receiver signals on all its intended uplinks but it will still be operable for most of its intended uplinks.

Figure 7:
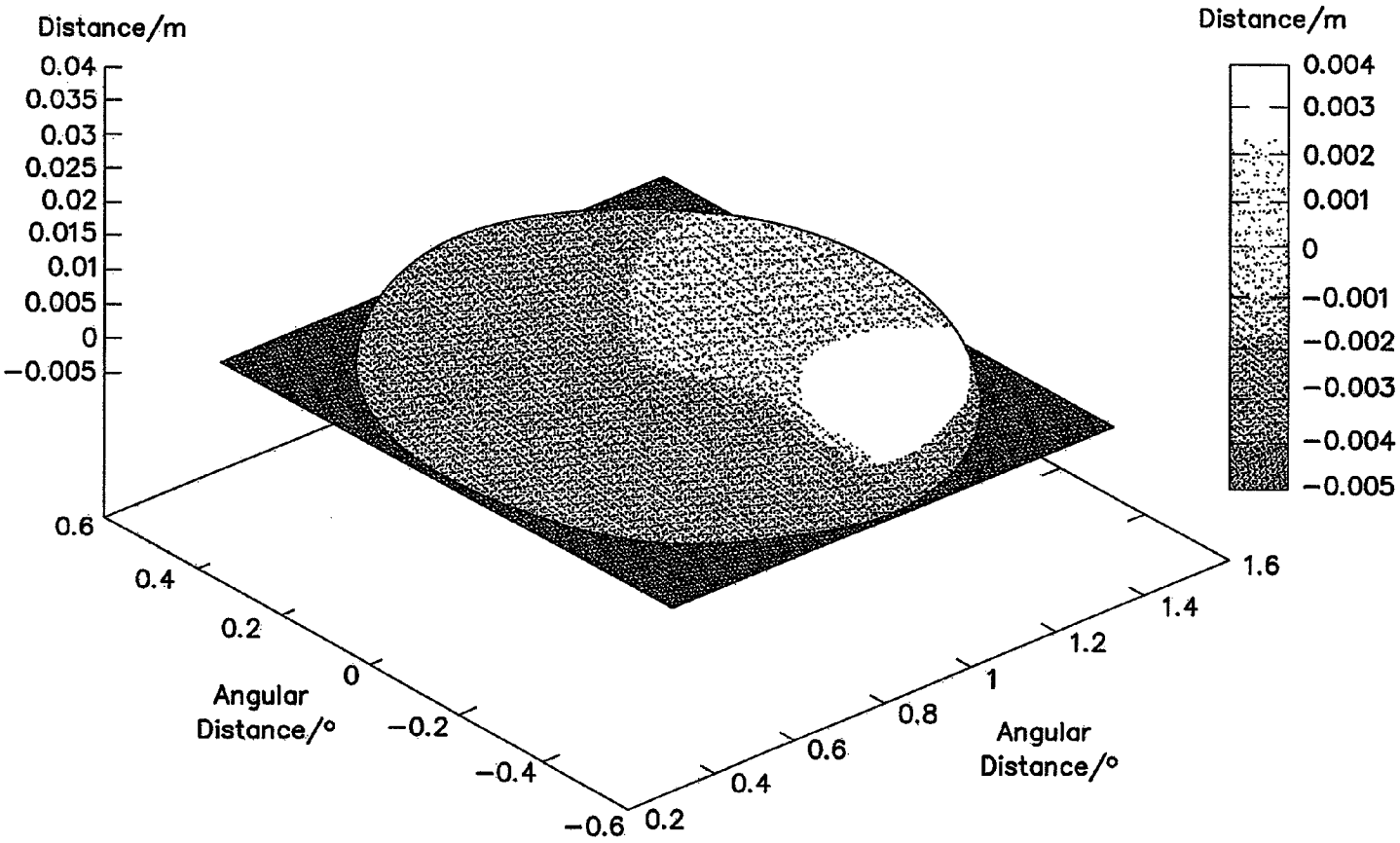
FIG. 7 shows a reflector according to another embodiment of the invention.

With reference to FIG. 7, the step does not have to be sharp to produce the required null. Instead, the step can be a smoothed out version of a mathematical, discontinuous step, as shown in FIG. 7. The smooth step does not have any sharp edges or corners. In one embodiment, the singularity is smoothed by convolution with a Bessel function. The smooth shape does not have a significant effect on the nulling performance but makes the reflector easier to manufacture.

The region of near-zero field strength produced by the stepped structures is robust to errors because the gain slope near the region of zero field strength is high. The same level of interfering power would move the region of minimum field strength produced by a stepped structure a proportionally smaller distance than it would move the region of minimum field strength produced by a conventional reflector.

Also, because of the mathematical nature of the null, a small interfering signal, while it will move the precise location of the null, will not cause null filling, and hence will not degrade the null depth. This is in contrast to the situation with conventional nulling, as demonstrated by FIGS. 9*a* and 9*b*. Typical errors include random surface errors on the reflector and errors in the beam pattern from the feed for which the reflector is designed.

Figure 1:
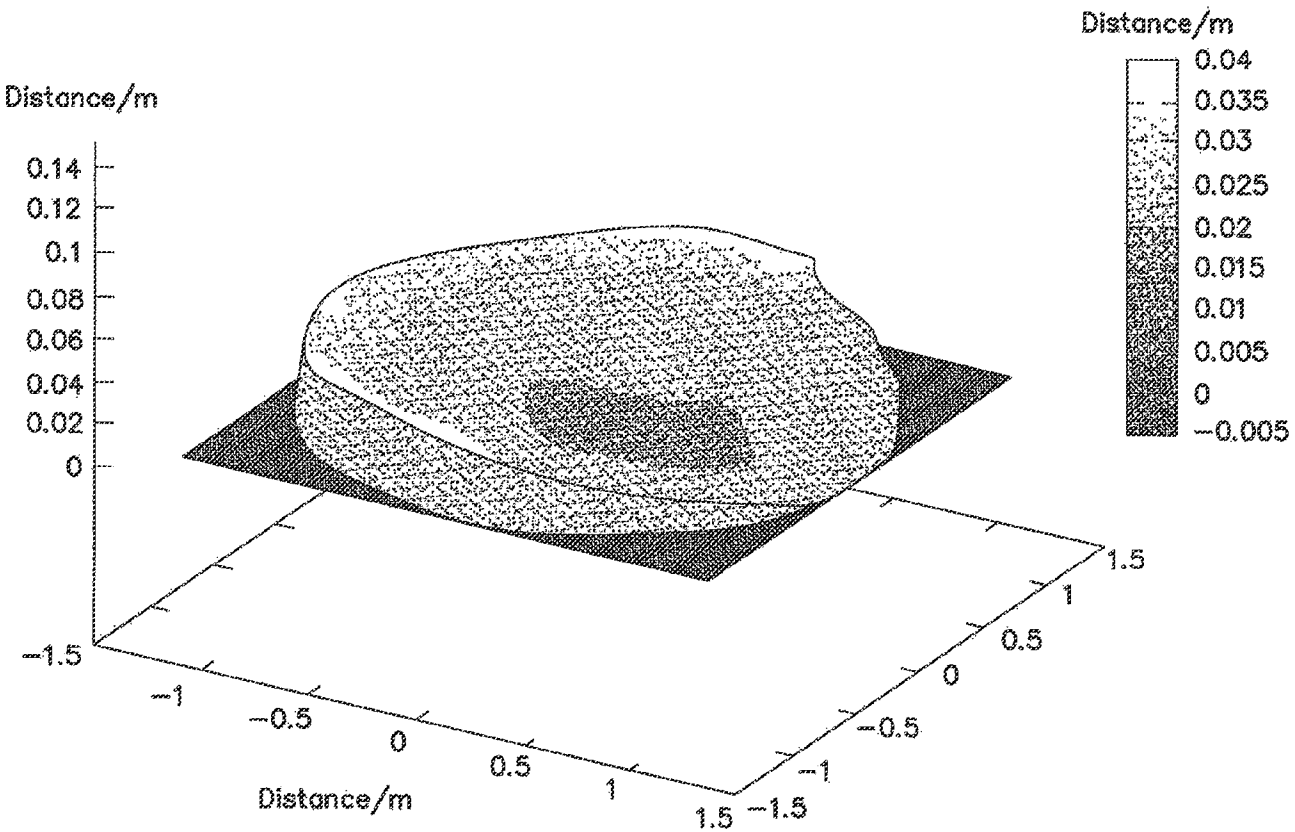
FIG. 1 (Prior Art)
FIG. 1 shows a conventional reflector for producing a far field response pattern with near-zero field strength in a predetermined region.
Figure 2:
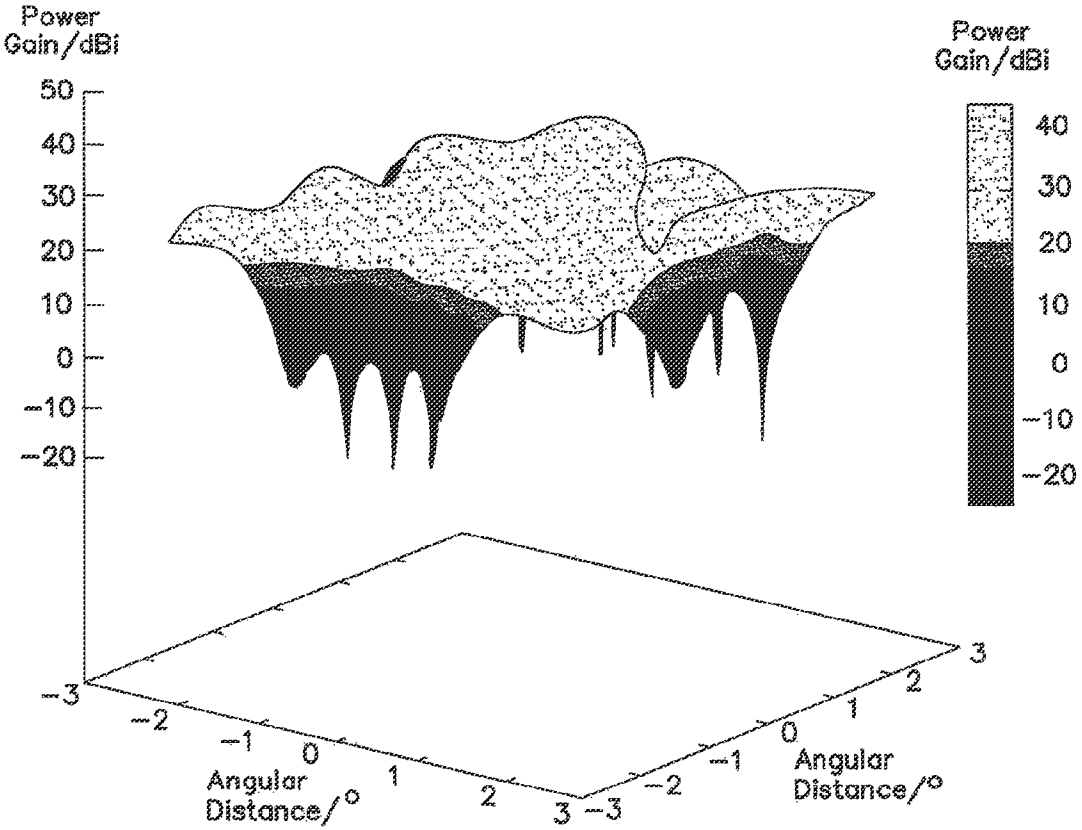
FIG. 2 (Prior Art)
FIG. 2 is a three dimensional illustration of a far field response pattern produced by a conventional reflector.
Figure 8A:
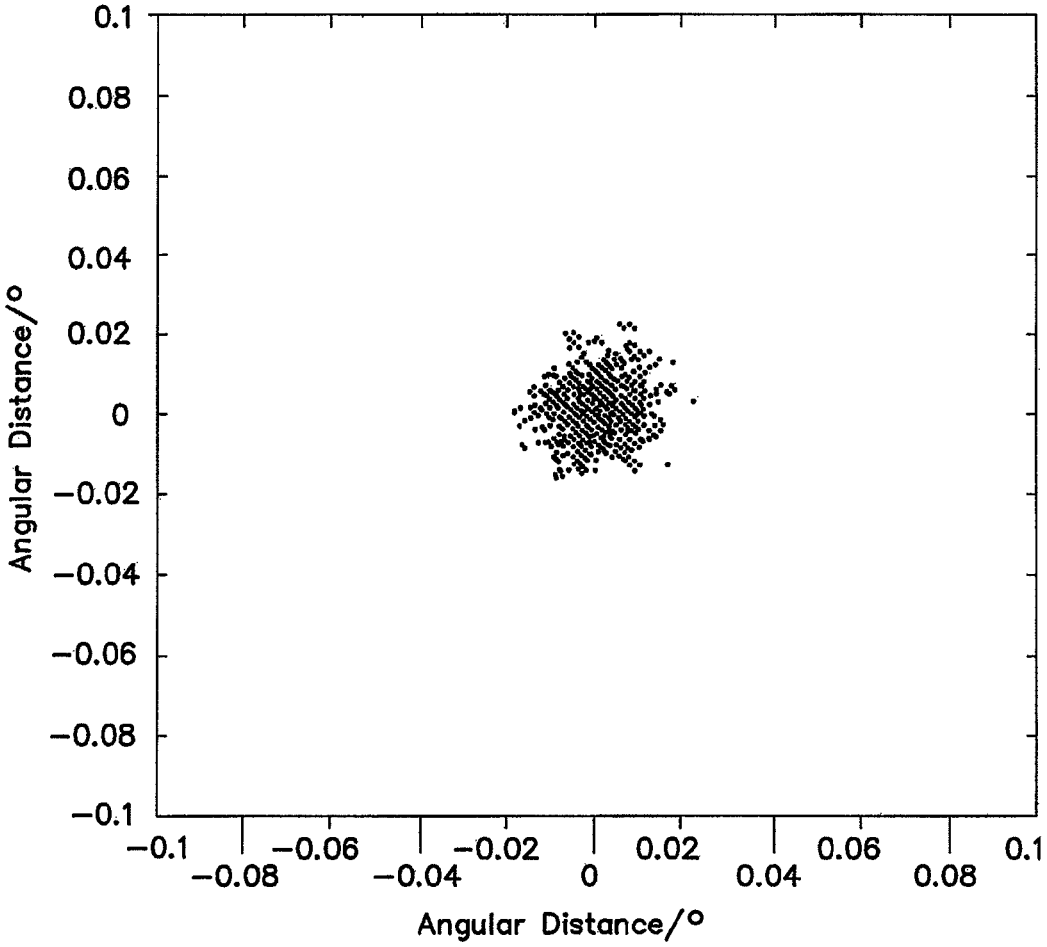
FIGS. 8*a* and 8*b* illustrate the angular displacement of the position of near-zero directivity with surface errors in a reflector with a radially stepped structure (a) and a conventional reflector (b)
Figure 8B:
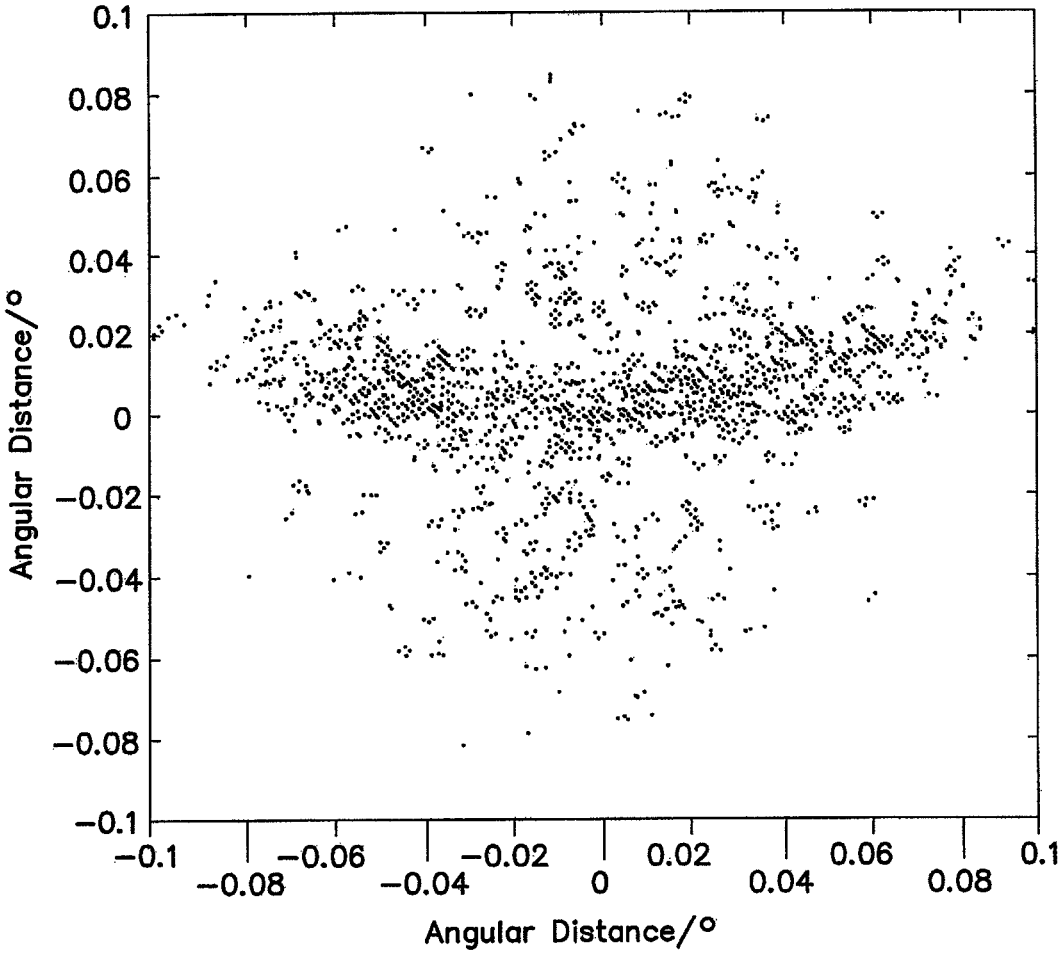

With reference to FIGS. 8*a* and 8*b*, the graphs show the variation in the locations of the minimum directivity for 1000 reflector antennas with random surface errors of fixed root mean square (rms) of 0.1 mm and minimum ripple period filtered to 0.2 m. FIG. 8*a* shows the results for a reflector with a radially stepped structure, of the type described with respect to FIGS. 4, 5 and 6, for producing the position of zero directivity and FIG. 8*b* shows the results for a conventional reflector of the type described with respect to FIGS. 1 and 2. The graphs have been generated using Monte Carlo analysis. The random error profiles have been produced by generating random values on a fine grid, filtering via Discrete Fourier Transform (DFT) and scaling for correct rms. It is clear from FIGS. 8*a* and 8*b* that the displacement of the location of the minimum directivity from its intended position at x=0 degrees and y=0 degrees is smaller for the reflector with a stepped structure than for the conventional reflector. Whereas the position of the null varies between −0.02 degrees and 0.02 degrees with the stepped structure, the position of the null produced by a conventional reflector varies between −0.1 and 0.1 degrees.

Figure 9A:
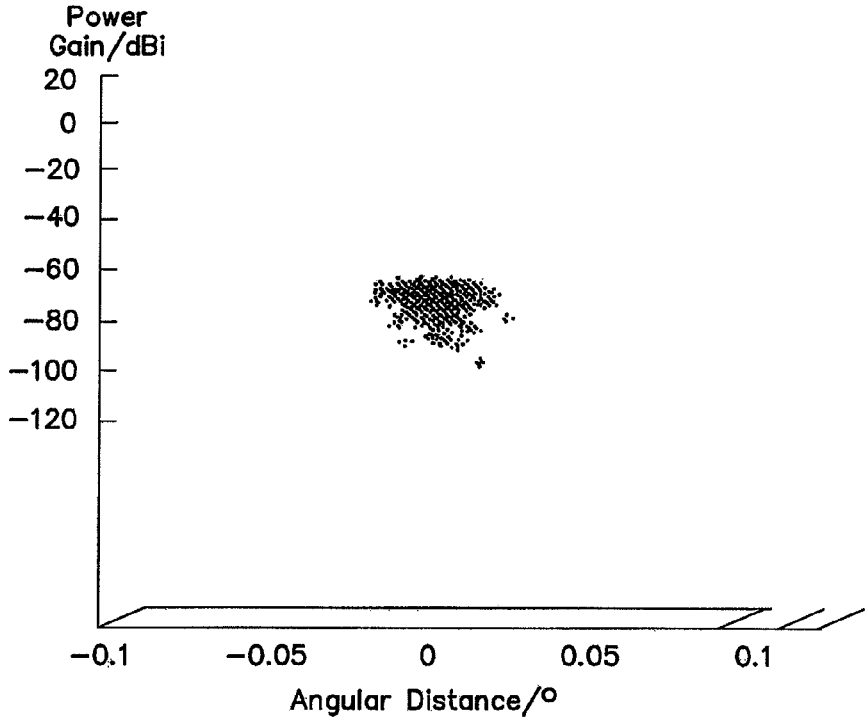
FIGS. 9*a* and 9*b* illustrate the variation in directivity of the near-zero directivity with surface errors in a reflector with a radially stepped structure (a) and a conventional reflector (b)
Figure 9B:
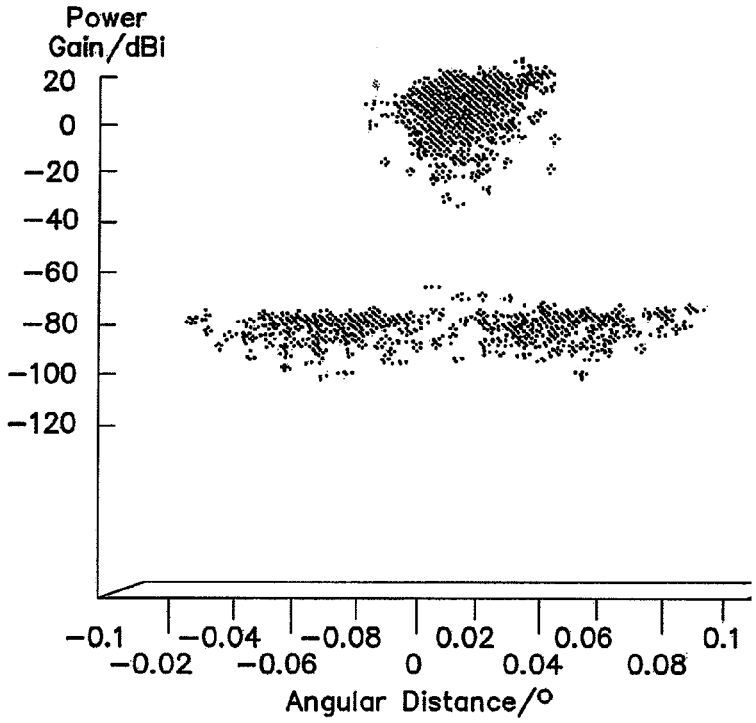

With reference to FIGS. 9*a* and 9*b*, the graphs show the variation in the depth of the minimum directivity for 1000 reflector antennas with random surface errors of fixed rms of 0.1 mm and minimum ripple period filtered to 0.2 m. FIG. 9*a* shows the results for a reflector with a stepped structure of the type described with respect to FIGS. 4, 5 and 6 and FIG. 9*b* shows the results for a conventional reflector of the type described with respect to FIGS. 1 and 2. The graphs have been generated using Monte Carlo analysis. The random error profiles have been produced by generating random values on a fine grid, filtering via DFT and scaling for correct rms. It is clear from FIGS. 9*a* and 9*b* that the depth of the null created using a radially stepped structure is not as sensitive to errors as the null created using a conventional reflector. Whereas random surface errors on the conventional reflector sometimes cause null filling (up to approximately 20 dBi in the graph of FIG. 9*b*), random surface errors on the reflector with a radially stepped structure do not significantly affect the depth of the null. In FIG. 9*b*, the surface errors sometimes increase the directivity of the null such that the null is unusable in practice. Consequently, the pattern produced by the reflector with a radially stepped structure is more robust to surface errors than the pattern produced by the conventional reflector.

In FIGS. 9*a* and 9*b*, the directivity at the position of minimum directivity is between approximately −60 dBi and −100 dBi. The reason for this variation is the lack of further precision in the program used to perform the simulation and find the location of minimum directivity. The gain slope at the null is so high that when the location search routine terminates, the distance from the actual null is enough to raise the directivity to approximately between −60 dBi and −100 dBi. Within the approximations applied in the system, the actual null is infinitely deep.

In the reflector arrangement of the communication system of FIG. 3, the displacement in the location of minimum directivity can be compensated for by rotating the reflector slightly using the positioning modules 7, 11. If the location of minimum directivity has been displaced by 0.02 degrees by random errors, the intended location can be re-established by rotating the reflector 0.02 degrees to reposition the point of minimum directivity. Using the example of a jamming signal, a jamming signal in the communication system of FIG. 3 may result in a received power of at least 100 times the intended received power. The reflector can be rotated using the positioning module 7 until the received power is reduced to its normal level. The satellite operator knows that when the received power is reduced, the region of zero directivity is directed at the source of the jamming signal. In other words, the position of zero directivity can be modified via reflector steering to minimise the received power and thereby prevent the antenna from being jammed. The steering is controlled by controller 13 which can be located either on the satellite or on the ground.

The zero directivity is also robust to variations in the radiation pattern of the feed due to, for example, manufacturing variations in dimensions, idealisations in the modelling software or thermal expansion. If an interferer were to transmit incoherent signals on both polarisations, the limiting factor is the cross-polar performance of the antenna. Traditional ways to improve the cross-polar performance of an unshaped offset reflector may be applied here to reduce this effect. For example by using a feed designed to eliminate the cross-polar produced from the main reflector by direct feed synthesis or by use of one or more sub reflectors to create an image feed at the main reflector focus.

Figure 10:
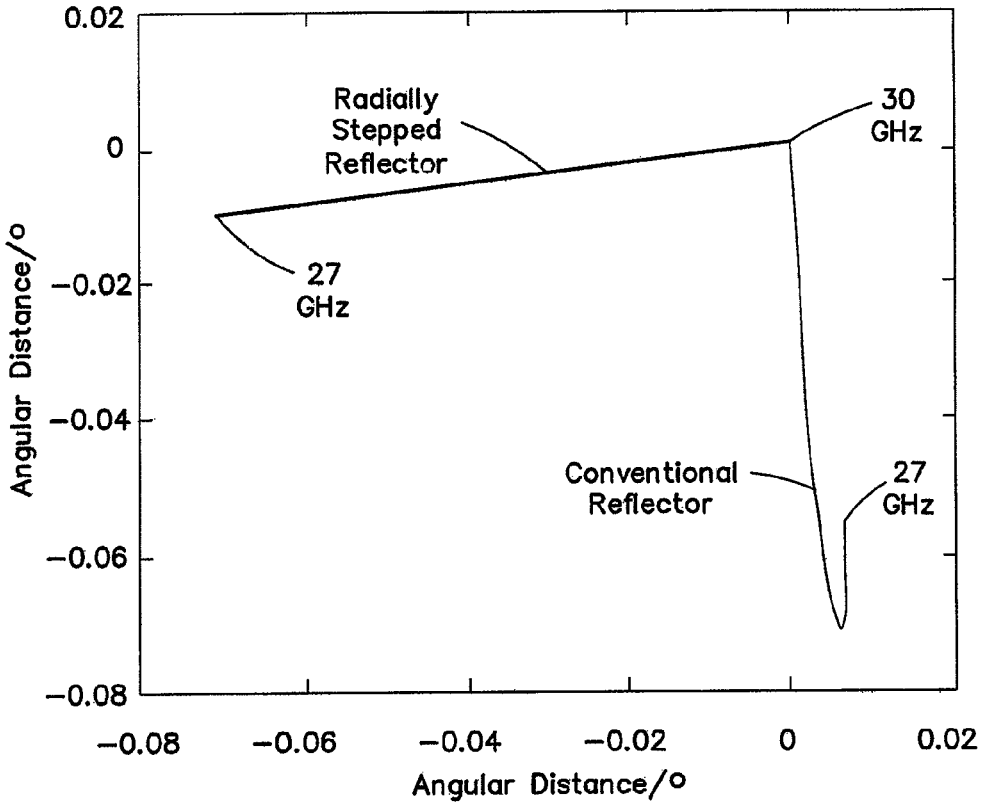
FIG. 10 illustrates the sensitivity to frequency of the reflector with a radially stepped structure and a conventional reflector.

With reference to FIG. 10, the angular displacement of the location of minimum directivity for a radially stepped reflector and a reflector shaped to produce a cancellation beam according to the conventional method is shown for a frequency between 27 GHz and 30 GHz. It is clear that at least in one direction, the reflector with a stepped structure is less sensitive to frequency variations. However, in the other direction, the location of the minimum directivity for a signal of 27 GHz is 0.06 degrees away from the location of the minimum directivity for a signal of 30 GHz. It has been found that the sensitivity to frequency variations can be further reduced by modifying the stepped structure as shown in FIG. 11.

Figure 11:
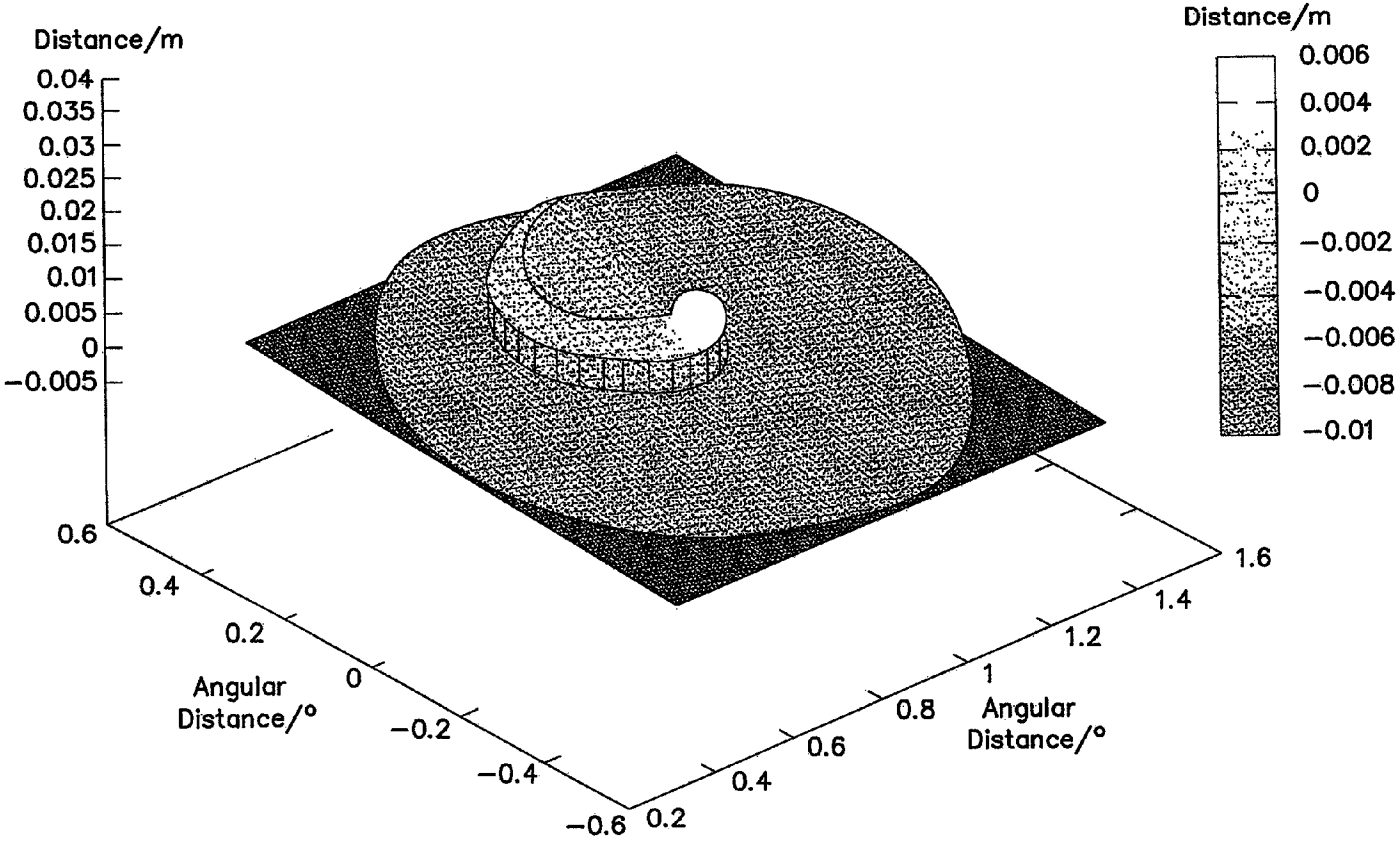
FIG. 11 shows a reflector according to a yet another embodiment of the invention.
Figure 12:
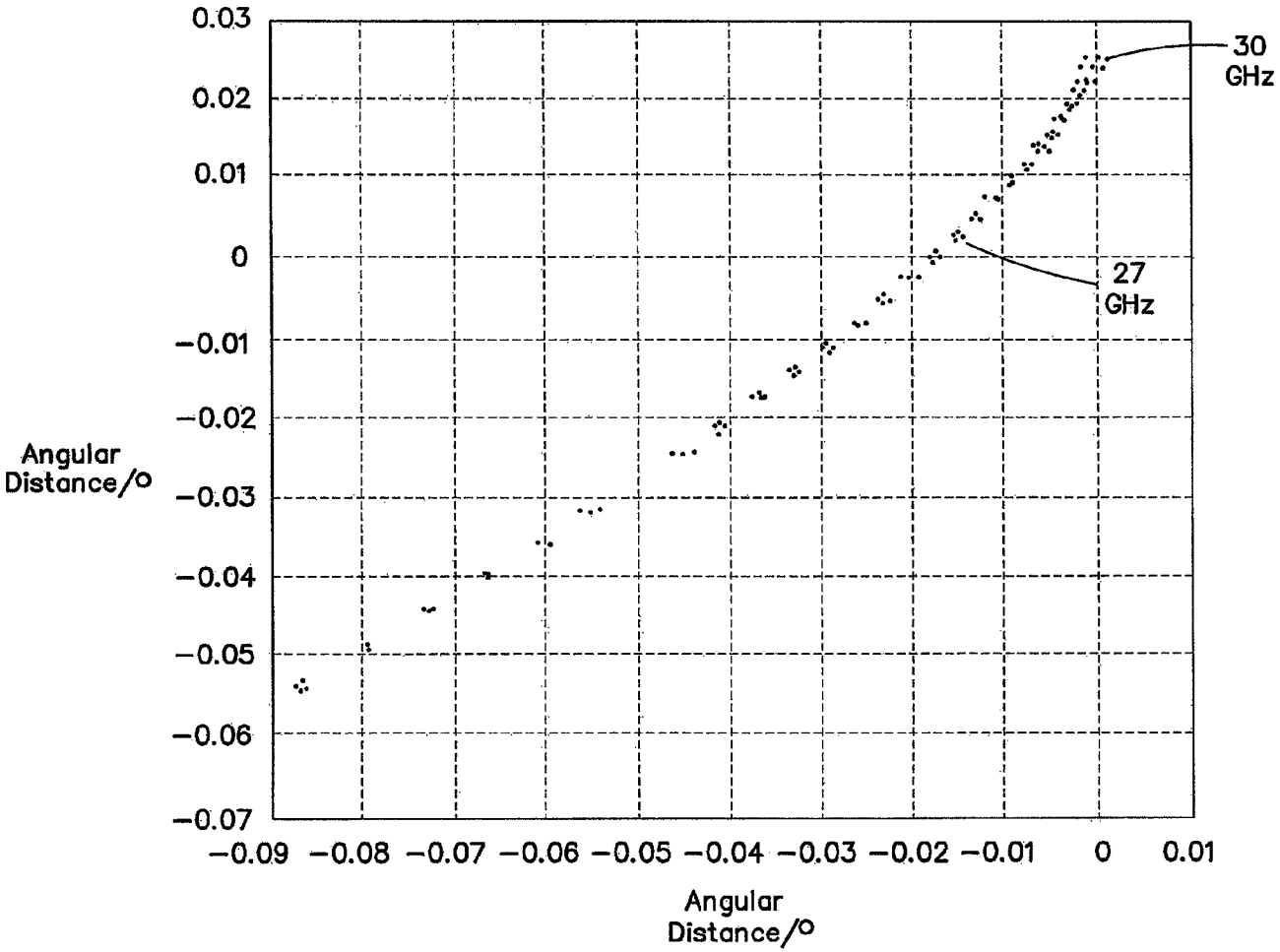
FIG. 12 illustrates the sensitivity to frequency of the reflector of FIG. 11.

With reference to FIG. 11, another embodiment of the reflector is shown in which the stepped structure for producing the near-Zero directivity is a spiral step. The displacement between 27 GHz and 30 GHz is reduced with the spiral cut as shown in FIG. 12. The location of the minimum directivity for a signal of 27 GHz is 0.015 degrees away from the location of the minimum directivity for a signal of 30 GHz. Thus, the sensitivity to frequency has been reduced by a factor of approximately 2. The points in the graph are 250 MHz apart. It is clear that the closer the frequency of the signal to 30 GHz, the less sensitive the zero directivity is to errors in the frequency. It should be realised that a spiral is just one example of a different configuration of the step and many other configurations of the step are possible. A particular configuration of a step would be chosen with consideration to the application for the reflector and acceptable error sensitivity.

In other embodiments of the reflector, the reflector may be shaped to produce a contoured beam but still have a region of zero or near-zero directivity. The reflector is produced by first shaping the reflector to produce the desired contoured beam without a null. The reflector may be shaped with reflector profile synthesis software which numerically Fourier transforms a desired far-field radiation pattern to determine the shape of the reflector required to produce the far-field radiation pattern. For example, the reflector may be shaped to produce a beam that covers a square area. The null is then inserted into the pattern by multiplication of the far field by the appropriate phase function, and an approximate aperture field generated by Fourier transform. This produces an aperture field bigger than the reflector so truncation is necessary. The shape of the far field can then be re-optimised by re-running the reflector profile synthesis, allowing only smooth changes relative to the initial version. Because the null is robust to surface errors, the null is not significantly affected by re-optimisation. The location of the zero directivity can be off centre or adjacent the contoured beam.

Figure 13:
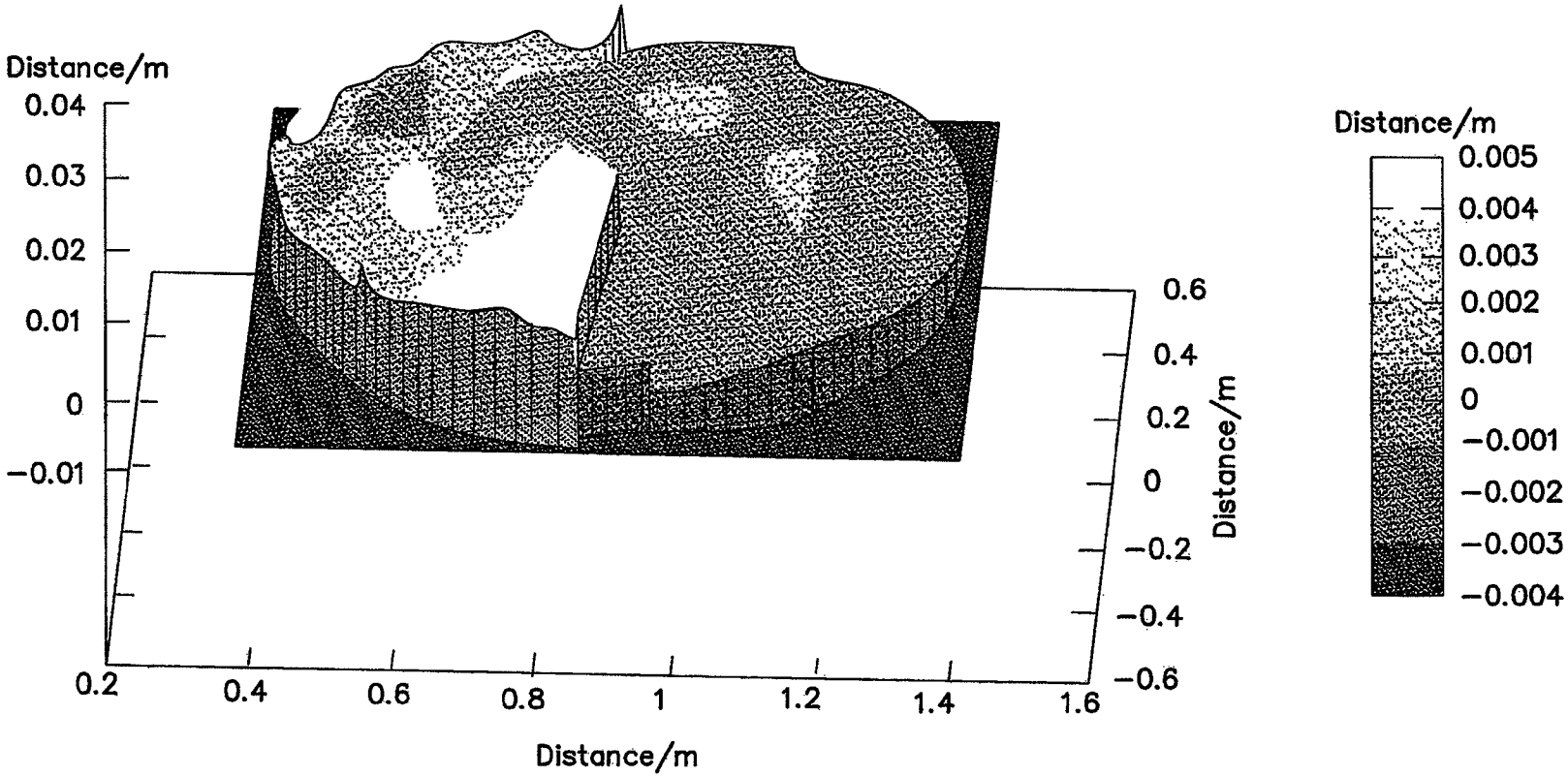
FIG. 13 shows a reflector according to yet another embodiment of the invention.
Figure 14:
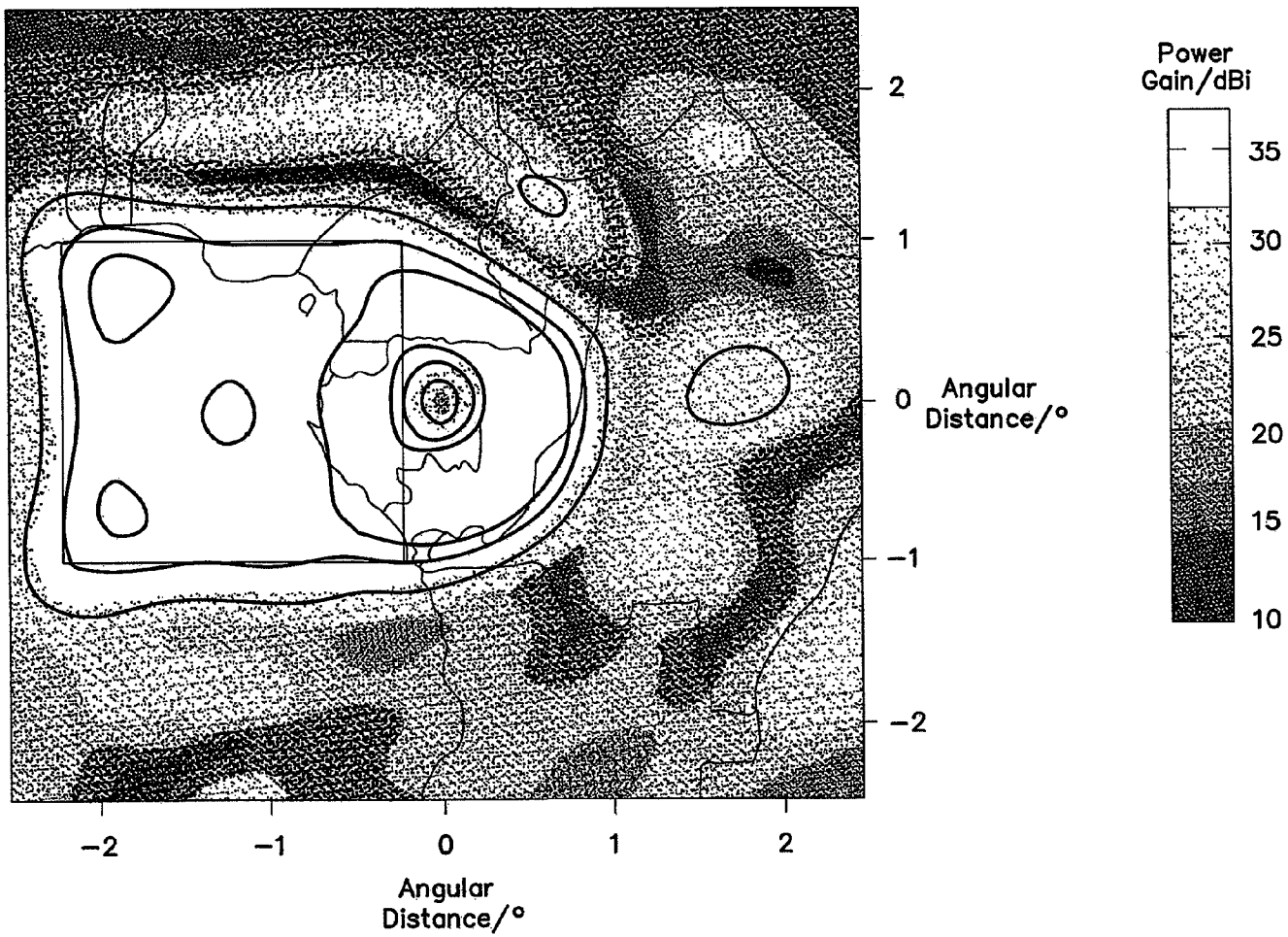
FIG. 14 is a contour diagram of the far field response pattern of the reflector of FIG. 13.

With reference to FIG. 13, a shaped reflector is shown that produces an approximately square beam pattern with a null inserted adjacent the square beam pattern. The null is inserted at 0.2 degrees from the side of the square. In FIG. 13, a small step on the other side of the reflector can be seen. This step could be eliminated by smoothing. The contour of the beam pattern is shown in FIG. 14. The contours at 37, 35 and 30 dBi are shown.

Figure 15:
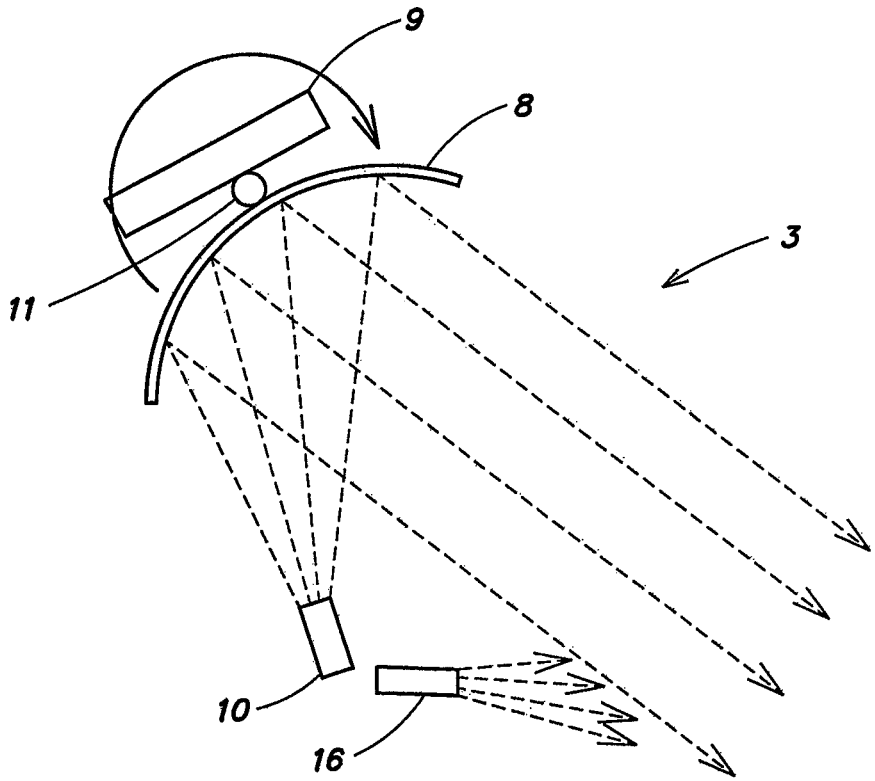
FIG. 15 is a schematic diagram of an antenna assembly of a communication system.

With reference to FIG. 15, the communication system may comprise, in addition to or as an alternative to the mechanism for rotating the reflector, a further radiator 16 for generating a radiation pattern that displaces the location of zero directivity an amount equal to the amount it has been displaced by, for example, surface errors The radiator 16 is positioned such that it points directly towards the far field and may be designed to generate a beam that covers substantially the same geographical region as the beam reflected by the reflector. In some embodiments, the further radiator 16 may be an additional feed located near the main feed 10 in the antenna as shown in FIG. 15. In contrast to the main feed 10, the additional feed is positioned to point directly towards the earth and not towards the reflector. The pattern of the further radiator may be low gain compared with the desired coverage. The further radiator 16 may be a simple low gain horn.

It should be realised that the additional radiator can be used to reposition the region of zero field strength in both a receive antenna arrangement and a transmit antenna arrangement since antennas are reciprocal. The additional feed may be a low gain receive antenna. The further radiator 16 can accordingly be used to reposition the region of near-zero field strength such that it is directed towards an area from which an interfering signal originates or to which it is desired to minimise the transmitted signal power.

Since the field close to the null increases linearly with distance from the null and has a phase which rotates around the null, the correct choice of amplitude and phase for the adjusting radiation from the additional radiator 16 will move the null a small distance without changing its appearance. The controller 13 may be used to control the additional radiator 16 to output a radiation pattern suitable for modifying the radiation pattern of the reflector. The correct relative amplitude and phase for creating the required radiation pattern can be determined by calculating the correlation between main and adjusting radiator signals, using standard techniques. For example, a simple power minimisation algorithm can be used to create a suitable radiation pattern.

The further radiator 16 could also be used to correct for frequency variations in the feed by controlling the radiator to produce a pattern that exhibits the correct degree of frequency sensitivity. The correct degree of frequency sensitivity may be produced by introducing additional adaptive amplitudes and phases.

For best performance with respect to frequency variation, the additional radiator 16 should be placed close to the phase centre of the antenna. This can be achieved by positioning the additional radiator 16 near the centre of the reflector instead of next to the main feed as shown in FIG. 15. In some embodiments, the additional radiator 16 can, for example, be arranged to protrude from a hole in the centre of the reflector. However, placing the additional radiator near the centre of the reflector can cause disturbance to the main antenna pattern due to blockage. In other embodiments, the additional radiator 16 is therefore placed near the edge of the main reflector to avoid blockage. Placing the additional radiator near the edge of the main reflector causes little disturbance to the main antenna pattern but puts a gentle phase gradient across the far field relative to the main pattern.

Whilst specific examples of the invention have been described, the scope of the invention is defined by the appended claims and not limited to the examples. The invention could therefore be implemented in other ways, as would be appreciated by those skilled in the art.

For instance, although the invention has been described with respect to a satellite communication system, it should be understood that the invention can be applied to any communication system that uses a reflector antenna. Moreover, although each reflector has been described to produce only one null it should be understood that further nulls can be produced in the beam by producing further steps in the profile of the reflector. The steps would not necessarily be straight cuts but could coalesce and reinforce each other.

Moreover, the reflector does not need to have a parabolic shape. The invention could also be used with, for example, flat plate subreflectors or any other type of suitable reflectors. It should also be understood that the technique for producing the null could be achieved in a dual reflector system, or other multi reflector systems. The invention could, for example, be implemented in a Gregorian or a Cassegrain reflector system. The steps for creating the zero directivity can be created in either or both of the main reflector and the subreflector. The invention could also be applied to dual-gridded antennas.

Furthermore, the invention as described could be realised with a reflector made from a material capable of surface reshaping dynamically or as a single irreversible instance in situ using an array of control points employing mechanical, piezoelectric, electrostatic or thermal actuators. An example realisation is a mesh controlled by a set of spring loaded ties with mechanical actuators.

The invention claimed is:

1. A satellite antenna arrangement for a satellite communication system comprising:

a reflector configured to produce a far field radiation pattern with near-zero field strength at a predetermined location in a main beam to reject unwanted signals from said predetermined location or minimise signal power transmitted to said predetermined location, the reflector having a surface comprising a stepped profile arranged to generate the near-zero field strength in the predetermined location, wherein the stepped profile extends radially from the centre of the reflector, and the height of the stepped profile is chosen to produce the near-zero field strength at the predetermined location in the main beam.

2. A satellite antenna arrangement according to claim 1, wherein the reflector is shaped to produce a contoured beam.

3. A satellite antenna arrangement according to claim 2, wherein the location of near-zero field strength is adjacent the contoured beam.

4. A satellite antenna arrangement according to claim 2, wherein the location of near-zero field strength is off centre with respect to the contoured beam.

5. A satellite antenna arrangement according to claim 1 further comprising a feed configured to receive radiation from said reflector or transmit radiation towards the reflector.

6. A satellite antenna arrangement according to claim 5 further comprising a radiator configured to generate a radiation pattern for repositioning the location of near-zero field strength.

7. A satellite antenna arrangement according to claim 6, wherein the feed comprises a first feed and said radiator comprises a second feed positioned to point directly towards the far field and configured to produce a beam that covers substantially the same region as a beam reflected by the reflector, the second feed being controllable to adjust the amplitude and phase of the beam of the second feed for repositioning the location of near-zero field strength.

8. A satellite antenna arrangement according to claim 1 further comprising a positioning mechanism configured to steer the reflector to reposition the location of near-zero field strength.

9. A satellite antenna arrangement according to claim 1, wherein the stepped profile comprises a radial step.

10. A satellite antenna arrangement according to claim 1, wherein the stepped profile comprises a spiral step.

11. A satellite antenna arrangement according to claim 1 wherein the stepped profile defines a phase singularity in the aperture field pattern of the antenna.

12. A satellite antenna arrangement according to claim 1, wherein the stepped profile comprises a smooth stepped profile.

13. A satellite antenna arrangement according to claim 1, wherein the phase of said far field pattern in the vicinity of the position of the near-zero field strength progressively increases through 360° with angular progression through 360° around the position and the amplitude of said far field pattern in the vicinity of the position varies substantially linearly about said position of near-zero field strength.

14. A satellite payload comprising the satellite antenna arrangement according to claim 1.

15. A satellite antenna arrangement according to claim 1, wherein the stepped profile comprises a step extending from an edge of the reflector to the centre of the reflector, and the height of the step is chosen to produce the near-zero field strength at a predetermined location in the main beam.

16. A reflector for a reflector antenna shaped to produce a contoured beam and comprising a stepped profile to generate a region of near-zero field strength in the far-field of the antenna, the stepped profile configured to extend radially from the centre of the reflector, the stepped profile further configured to generate the region of near-zero field strength at a predetermined location off centre or adjacent the contoured beam, and the height of the stepped profile is chosen to produce the near-zero field strength at the predetermined location.

17. A reflector according to claim 16, wherein the stepped profile comprises a radial or a spiral step.

18. A satellite antenna comprising:

a reflector;

a first radiator configured to receive radiation reflected from the reflector or to generate radiation for reflection by the reflector; and a second radiator configured to produce a beam that covers substantially the same region as a beam reflected by the reflector, the reflector comprising a stepped profile arranged to generate a region of near-zero field strength in a main beam of the far-field radiation pattern of the antenna, wherein the stepped profile extends radially from the centre of the reflector, the height of the stepped profile being chosen to produce the near-zero field strength at a predetermined location in the main beam, and the second radiator being controllable to adjust the amplitude and phase of the beam of the second radiator for repositioning the location of the near-zero field strength.

* * * * *